US011467533B2

(12) United States Patent
Hachiya et al.

(10) Patent No.: US 11,467,533 B2
(45) Date of Patent: Oct. 11, 2022

(54) IMAGE FORMING APPARATUS

(71) Applicant: BROTHER KOGYO KABUSHIKI KAISHA, Nagoya (JP)

(72) Inventors: Shunsuke Hachiya, Toyoake (JP); Masaaki Wakizaka, Nagoya (JP); Kentaro Aoyama, Nagoya (JP); Shinta Sugiura, Nagoya (JP); Toshinori Araki, Hekinan (JP); Keita Inoue, Konan (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/380,647

(22) Filed: Jul. 20, 2021

(65) Prior Publication Data

US 2022/0026847 A1 Jan. 27, 2022

(30) Foreign Application Priority Data

Jul. 22, 2020 (JP) ..... JP2020-125615

(51) Int. Cl.

*G03G 21/20* (2006.01)
*G03G 21/16* (2006.01)
*G03G 21/18* (2006.01)

(52) U.S. Cl.

CPC ..... *G03G 21/203* (2013.01); *G03G 21/1604* (2013.01); *G03G 21/1619* (2013.01); *G03G 21/1842* (2013.01); *G03G 21/20* (2013.01)

(58) Field of Classification Search

CPC ..... G03G 21/1604; G03G 21/1619; G03G 21/1842; G03G 21/20; G03G 21/203

See application file for complete search history.

(56) References Cited

U.S. PATENT DOCUMENTS

2015/0277313 A1* 10/2015 Aiba ..... G03G 15/2053 399/329
2016/0342135 A1* 11/2016 Fujiya ..... G03G 15/0208
2020/0112644 A1 4/2020 Shingai et al.
2020/0166884 A1* 5/2020 Kadota ..... G03G 15/80

FOREIGN PATENT DOCUMENTS

JP 2014-119526 A 6/2014
JP 2020-57972 A 4/2020

* cited by examiner

*Primary Examiner* — Joseph S Wong
(74) *Attorney, Agent, or Firm* — Merchant & Gould P.C.

(57) ABSTRACT

An image forming apparatus includes a housing, a drawer, an operation panel, and a sensor. The housing includes a first side wall having a first opening, and a second side wall having a vent and extending in a direction crossing the first side wall. The drawer supports a cartridge. The drawer is movable through the first opening between an inner position at which the drawer is accommodated in the housing and an outer position at which a part of the drawer is exposed to outside the housing. At least part of the operation panel protrudes from an outer surface of the second side wall. The sensor is arranged in the housing between the drawer and the second side wall. The sensor is configured to detect at least temperature or humidity of ambient air taken in through the vent.

12 Claims, 6 Drawing Sheets

IMAGE FORMING APPARATUS

CROSS REFERENCE TO RELATED APPLICATIONS

This application claims priority from Japanese Patent Application No. 2020-125615 filed Jul. 22, 2020. The entire content of the priority application is incorporated herein by reference.

TECHNICAL FIELD

This disclosure relates to an image forming apparatus.

BACKGROUND

Conventionally, in an image forming apparatus such as a laser printer, a drawer that supports a process cartridge is pulled out to the front side of the apparatus so that the process cartridge can be replaced. Further, in order to maintain the print quality by optimum control, an image forming apparatus provided with a sensor that detects the ambient temperature and the ambient humidity are known. For example, an image forming apparatus is disclosed in which a temperature sensor and a humidity sensor are arranged inside a vent on a side surface of the apparatus.

SUMMARY

According to one aspect, this specification discloses an image forming apparatus. The image forming apparatus includes a housing, a drawer, an operation panel, and a sensor. The housing includes a first side wall having a first opening, and a second side wall having a vent and extending in a direction crossing the first side wall. The drawer supports a cartridge. The drawer is movable through the first opening between an inner position at which the drawer is accommodated in the housing and an outer position at which a part of the drawer is exposed to outside the housing. At least part of the operation panel protrudes from an outer surface of the second side wall. The sensor is arranged in the housing between the drawer and the second side wall. The sensor is configured to detect at least temperature or humidity of ambient air taken in through the vent.

According to another aspect, this specification also discloses an image forming apparatus. The image forming apparatus includes a housing, an operation panel, and a sensor. The housing includes a first side wall, a second side wall, a first frame, and a second frame. The first side wall has a first opening. The second side wall has a vent and crosses the first side wall. The first frame and the second frame are arranged to face each other in a first direction, wherein the first frame is closer to the second side wall than the second frame is in the first direction. At least part of the operation panel protrudes from an outer surface of the second side wall in the first direction. The sensor is arranged in the housing between the first frame and the second side wall in the first direction. The sensor is configured to detect at least temperature or humidity of ambient air taken in through the vent.

BRIEF DESCRIPTION OF THE DRAWINGS

Embodiments in accordance with this disclosure will be described in detail with reference to the following figures wherein.

DETAILED DESCRIPTION

The above configuration can be adopted even in an image forming apparatus provided with a drawer because the configuration does not interfere with pulling out the drawer. However, when the image forming apparatus is installed, if the side surface of the apparatus at which the temperature sensor and the humidity sensor are arranged is located adjacent to a wall surface of the place where the image forming apparatus is installed, outside air cannot be taken in sufficiently from the vent. Therefore, the temperature sensor and the humidity sensor cannot accurately detect the ambient temperature and the ambient humidity.

In view of the foregoing, an aspect of an objective of this disclosure is to provide an image forming apparatus configured to accurately detect the ambient temperature and the ambient humidity even when the apparatus is arranged adjacent to a wall surface.

[Overall Configuration of Image Forming Apparatus]

Figure 1:
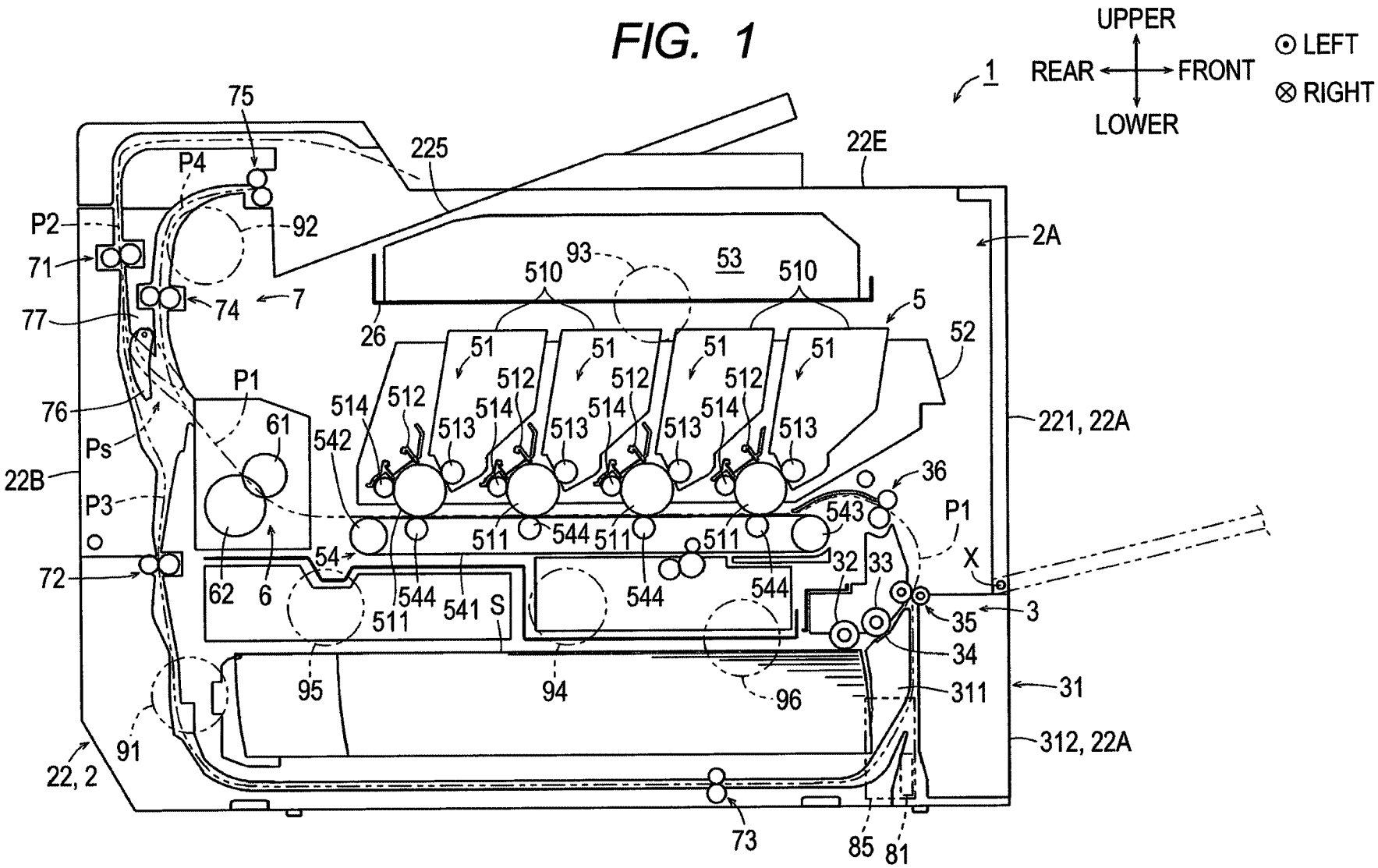
FIG. 1 is a central cross-sectional view of an image forming apparatus according to an embodiment.

An image forming apparatus 1 shown in FIG. 1 according to one embodiment is a color laser printer that forms an image of a plurality of colors on a sheet S by an electrophotographic method. Alternatively, the image forming apparatus 1 may be a monochrome laser printer that forms a monochromatic image on the sheet S, or may be an LED (Light Emitting Diode) printer.

In the following description, the right side in FIG. 1 is defined as the front side of the image forming apparatus 1, the left side in FIG. 1 is defined as the rear side of the image forming apparatus 1, the near side in the direction perpendicular to the drawing surface of FIG. 1 is defined as the left side of the image forming apparatus 1, and the far side in the direction perpendicular to the drawing surface of FIG. 1 is defined as the right side of the image forming apparatus 1. Further, the upper side and the lower side in FIG. 1 are defined as the upper side and the lower side of the image forming apparatus 1, respectively. The left-right direction is an example of a direction in which a first side wall extends, and the front-rear direction is an example of a direction in which a second side wall extends.

The image forming apparatus 1 includes a housing 2, a feed unit 3 for feeding the sheet S, an image forming unit 5 for forming an image on the sheet S, a fixing unit 6 for fixing an image on the sheet S, a sheet conveyance unit 7 for conveying the sheet S on which an image is formed by the image forming unit 5, and a plurality of drive motors 91 to 96.

The housing 2 is a box body formed in a substantially rectangular parallelepiped shape, and accommodates the feed unit 3, the image forming unit 5, the fixing unit 6, and the sheet conveyance unit 7. The housing 2 includes a frame 21 (see FIG. 6) that supports each portion, and a cover 22 that covers the frame 21 and forms an appearance. The cover 22 includes a front wall 22A as an example of the first side wall, a rear wall 22B, a left wall 22C as an example of the second side wall, a right wall 22D, and an upper wall 22E. Note that the first side wall of the housing 2 may be any of the front wall 22A, the rear wall 22B, the left wall 22C, and the right wall 22D of the cover 22, and the second side wall may be a side wall extends in a direction crossing the first side wall.

The front wall 22A of the cover 22 has a first opening 2A and a front cover 221 usable for opening and closing the first opening 2A. The front cover 221 forms an upper portion of the front wall 22A. The front cover 221 is configured to rotationally move about a rotational axis X at its lower end. In response to rotational movement of the front cover 221 about the rotational axis X, the front cover 221 is movable between a closed position for closing the first opening 2A (a position indicated by solid lines in FIG. 1) and an open position for opening the first opening 2A (a position indicated by double-dot chain lines in FIG. 1). By moving the front cover 221 to the open position and opening the first opening 2A, a drawer 52 described later can be pulled out of the housing 2 through the first opening 2A.

Figure 2:
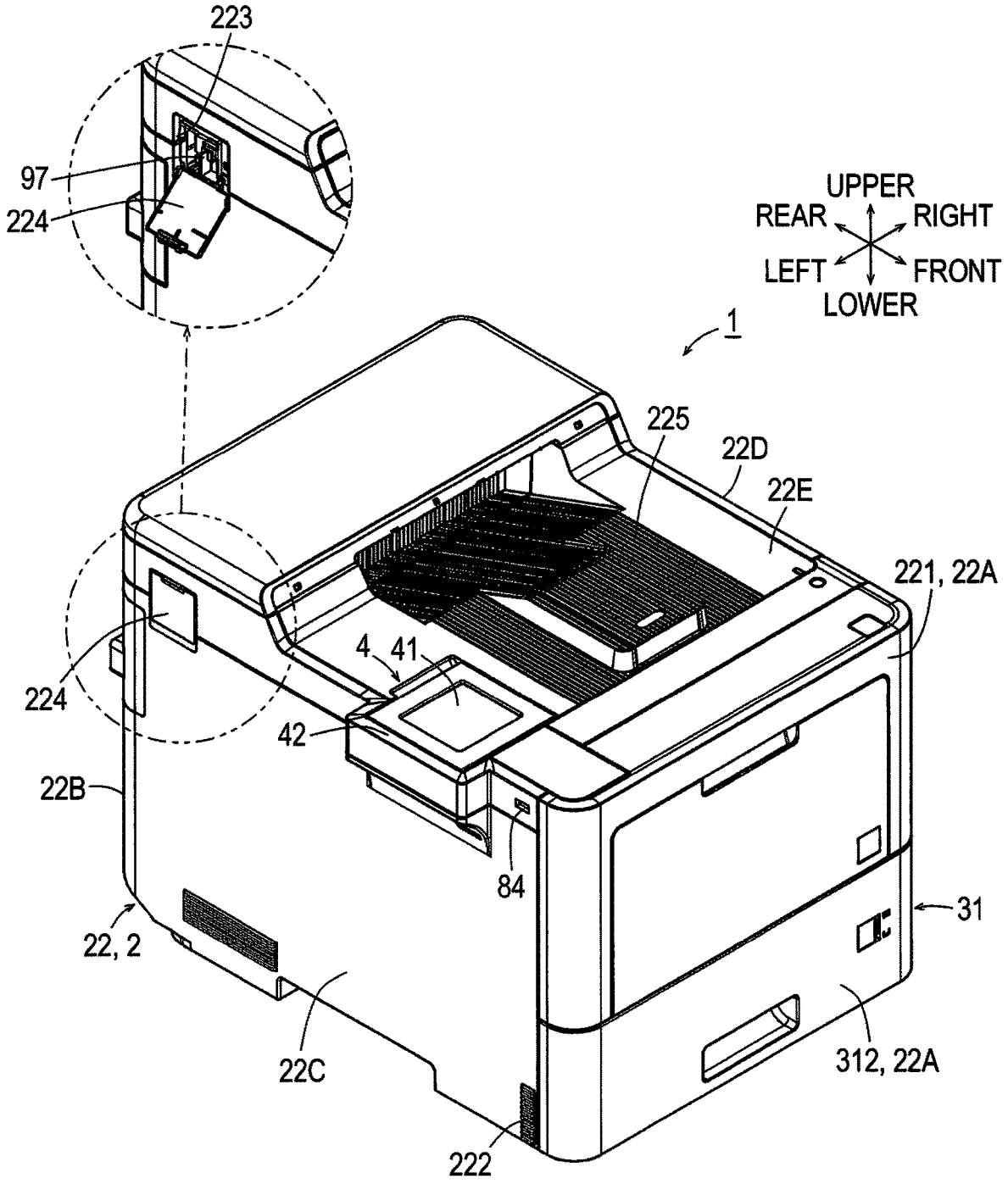
FIG. 2 is a perspective view of the image forming apparatus of the embodiment.

As shown in FIG. 2, the left wall 22C of the cover 22 has a vent 222, a second opening 223, and a lid 224. The vent 222 is a slit-like opening formed at a lower front position of the left wall 22C. The vent 222 functions as an intake port through which outer air is to be taken in for measuring the ambient temperature and the ambient humidity in a place where the image forming apparatus 1 is installed. The second opening 223 is a substantially rectangular opening formed at an upper rear position of the left wall 22C. The lid 224 is configured to rotationally move about its lower end so as to allow opening and closing of the second opening 223. The second opening 223 is used for connecting an optional part such as a wireless local area network (WLAN) board.

As shown in FIG. 1, the upper wall 22E of the cover 22 includes a discharge tray 225 for supporting the sheet S on which an image is formed. The discharge tray 225 has a recessed shape slanted downward from the front side toward the rear side.

The feed unit 3 includes a sheet tray 31, a feed roller 32, a separation roller 33, a separation pad 34, a conveyance roller pair 35, and a registration roller pair 36. A conveyance path P1 is formed in the housing 2 along which the sheet S from the sheet tray 31 is passed through the interior of the image forming unit 5.

The sheet tray 31 is provided at a lower portion of the housing 2 so as to be slidable in the front-rear direction. The sheet tray 31 includes a tray main body 311 on which a plurality of sheets S to be fed to the image forming unit 5 are supported in a stacked state, and a tray cover 312 provided at a front portion of the tray main body 311. The size of the tray cover 312 is larger than the size of the tray main body 311 in the vertical direction and in the right-left direction, and forms a lower portion of the front wall 22A of the cover 22. The sheet tray 31 is movable between an accommodated position at which the sheet tray 31 is accommodated inside the housing 2 (a position shown in FIG. 1) and a pulled-out position at which the sheet tray 31 is pulled out forward from the housing 2.

The sheets S supported on the sheet tray 31 are fed one sheet at a time to the conveyance path P1 by the feed roller 32, the separation roller 33, and the separation pad 34. The sheet S fed to the conveyance path P1 is conveyed toward the image forming unit 5 by the conveyance roller pair 35 and the registration roller pair 36.

The image forming unit 5 includes four drum units 51, the drawer 52, a scanner unit 53, and a conveyance unit 54. The four drum units 51 are arranged side by side in the front-rear direction and above the feed unit 3. Each drum unit 51 includes a toner cartridge 510, a photosensitive drum 511, a charger 512, a development roller 513 provided at the toner cartridge 510, and a drum cleaning roller 514, each of which being provided for a corresponding one of colors including black, yellow, magenta, and cyan. The toner cartridge 510 is an example of a cartridge supported by the drawer 52, and the cartridge may be any member of the drum unit 51.

The drawer 52 supports the drum unit 51 and is provided at the housing 2 so as to be slidable in the front-rear direction. The drawer 52 supports the toner cartridge 510 such that the toner cartridge 510 is attachable to the drawer 52 from above. The drawer 52 is movable between an inner position at which the drawer 52 is accommodated in the housing 2 through the first opening 2A and an outer position at which the drawer 52 is partially exposed to the outside of the housing 2.

The scanner unit 53 is provided at an upper portion of the interior of the housing 2. In the scanner unit 53, laser light based on image data passes through a polygon mirror, a lens, a reflector, and so on, and is then emitted from the scanner unit 53. The laser light emitted from the scanner unit 53 is irradiated onto the surface of the photosensitive drum 511 for each color at high-speed scanning.

The conveyance unit 54 includes a transfer belt 541, a drive roller 542, a follow roller 543, and a transfer roller 544. The transfer belt 541 is arranged below the photosensitive drums 511 with the conveyance path P1 interposed therebetween. The transfer belt 541 is stretched between the drive roller 542 and the follow roller 543 arranged at the front of the drive roller 542. The transfer roller 544 is arranged at a position facing a corresponding one of the photosensitive drums 511 with the transfer belt 541 interposed therebetween.

In the image forming unit 5, the photosensitive drums 511 charged uniformly by the corresponding chargers 512 are exposed to light selectively by the scanner unit 53. As a result of this light exposure, charge is removed selectively from the surfaces of the photosensitive drums 511 to form electrostatic latent images on the surfaces of the photosensitive drums 511.

A development bias is applied to the development roller 513. When the electrostatic latent image formed on each photosensitive drum 511 faces the development roller 513 to generate a potential difference between the electrostatic latent image and the development roller 513, toner is supplied from the development roller 513 to the electrostatic latent image on the photosensitive drum 511. With this operation, a toner image is formed on the surface of the photosensitive drum 511.

When the sheet S conveyed toward the image forming unit 5 is moved onto the transfer belt 541, the sheet S is conveyed by the transfer belt 541 to pass through between the transfer belt 541 and the photosensitive drums 511 sequentially. Then, when the toner image on the surface of the photosensitive drum 511 faces the sheet S, the toner image is transferred to the sheet S by a transfer bias applied to the transfer roller 544.

At this time, toner not having been transferred to the sheet S may remain on the surface of the photosensitive drum 511. In response to rotation of the photosensitive drum 511, the waste toner remaining on the surface of the photosensitive drum 511 is electrically borne on the surface of the drum cleaning roller 514 by a drum cleaning bias.

The fixing unit 6 is arranged downstream of the image forming unit 5 in a conveyance direction in which the sheet S is conveyed. The fixing unit 6 includes a heating roller 61 for heating the sheet S and a pressure roller 62 arranged to face the heating roller 61. After the toner image is transferred to the sheet S by the image forming unit 5, the sheet S is conveyed to the fixing unit 6. The sheet S conveyed to the fixing unit 6 passes between the heating roller 61 and the pressure roller 62 in pressure contact with each other, thereby the toner image is thermally fixed.

The sheet S with the thermally fixed toner image is conveyed downstream of the fixing unit 6 in the conveyance direction by the sheet conveyance unit 7. The sheet S conveyed by the sheet conveyance unit 7 is discharged to the discharge tray 225, or conveyed again toward the image forming unit 5 along a conveyance path P3 forming a re-conveyance path described later.

The sheet conveyance unit 7 has a conveyance path P2, the conveyance path P3, and a conveyance path P4. The conveyance path P2 is a path extending upward from a branch position Ps at the conveyance path P1 and used for conveying the sheet S having passed through the conveyance path P1. The conveyance path P3 is a path extending downward from the branch position Ps and used for conveying the sheet S having passed through the conveyance path P2. The conveyance path P4 is a path extending upward from the branch position Ps and used for conveying the sheet S having passed through the conveyance path P1.

The conveyance path P2 and the conveyance path P3 form the re-conveyance path for conveying the sheet S again toward the image forming unit 5 after the sheet S is conveyed downstream of the image forming unit 5 in the conveyance direction. In the image forming apparatus 1, when performing duplex printing on the sheet S, for example, after the sheet S is conveyed downstream of the image forming unit 5 in the conveyance direction, the sheet S is conveyed again toward the image forming unit 5 along the conveyance path P2 and the conveyance path P3.

When performing duplex printing on the sheet S, the conveyance path P2 is used as a path for switching back the sheet S conveyed from the image forming unit 5 to switch the front side and the back side of the sheet S. The conveyance path P2 extends diagonally rearward and upward from the branch position Ps.

The conveyance path P2 is provided with a switchback roller pair 71 which is rotatable forward and backward. The switchback roller pair 71 is configured to be driven in a forward rotational direction for introducing the sheet S into the conveyance path P2 and in a backward rotational direction for conveying the sheet S from the conveyance path P2 to the conveyance path P3.

The conveyance path P3 is a path branching off at the branch position Ps and used for conveying the switched back sheet S again toward the image forming unit 5. The conveyance path P3 extends downward from the branch position Ps, is then bent forward, and is bent further upward to join the conveyance path P1. While the conveyance path P3 shown in FIG. 1 passes below the sheet tray 31, the conveyance path P3 may alternatively be configured to pass above the sheet tray 31.

The sheet S having been conveyed to the conveyance path P3 is conveyed toward the image forming unit 5 by an intermediate re-conveyance roller pair 72 and a re-conveyance roller pair 73 provided at the conveyance path P3. The intermediate re-conveyance roller pair 72 is located at a portion of the conveyance path P3 extending downward from the branch position Ps. The re-conveyance roller pair 73 is located at a portion of the conveyance path P3 extending in the front-rear direction.

The conveyance path P4 is a path for guiding the sheet S having been conveyed along the conveyance path P1 toward the discharge tray 225. When performing duplex printing on the sheet S, the conveyance path P4 is also used as a path for switching back the sheet S having been conveyed from the image forming unit 5 to switch the front side and the back side of the sheet S. The conveyance path P4 extends upward from the branch position Ps, and then extends forward toward the discharge tray 225.

The conveyance path P4 is provided with an intermediate discharge roller pair 74 which is rotatable forward and backward, and a discharge roller pair 75 which is rotatable forward and backward. The discharge roller pair 75 is located downstream of the intermediate discharge roller pair 74 in the conveyance direction. The intermediate discharge roller pair 74 is configured to be driven in a forward rotational direction for introducing the sheet S into the conveyance path P4 and in a backward rotational direction for conveying the sheet S from the conveyance path P4 to the conveyance path P3. The discharge roller pair 75 is configured to be driven in a forward rotational direction for introducing the sheet S into the conveyance path P4 and in a backward rotational direction for conveying the sheet S from the conveyance path P4 to the conveyance path P3.

The sheet conveyance unit 7 includes a flapper 76. The flapper 76 is located at the branch position Ps. The flapper 76 is supported by a guide member 77 so as to rotationally move about an upper end thereof. By rotationally move, the flapper 76 switches the conveyance direction of the sheet S having passed through the conveyance path P1 between the conveyance path P2 and the conveyance path P4. Specifically, the flapper 76 is switched between a first position (a position indicated by a solid line in FIG. 1) for guiding the sheet S from the conveyance path P1 to the conveyance path P4 and a second position (a position indicated by double-dot chain lines in FIG. 1) for guiding the sheet S from the conveyance path P1 to the conveyance path P2.

Figure 6:
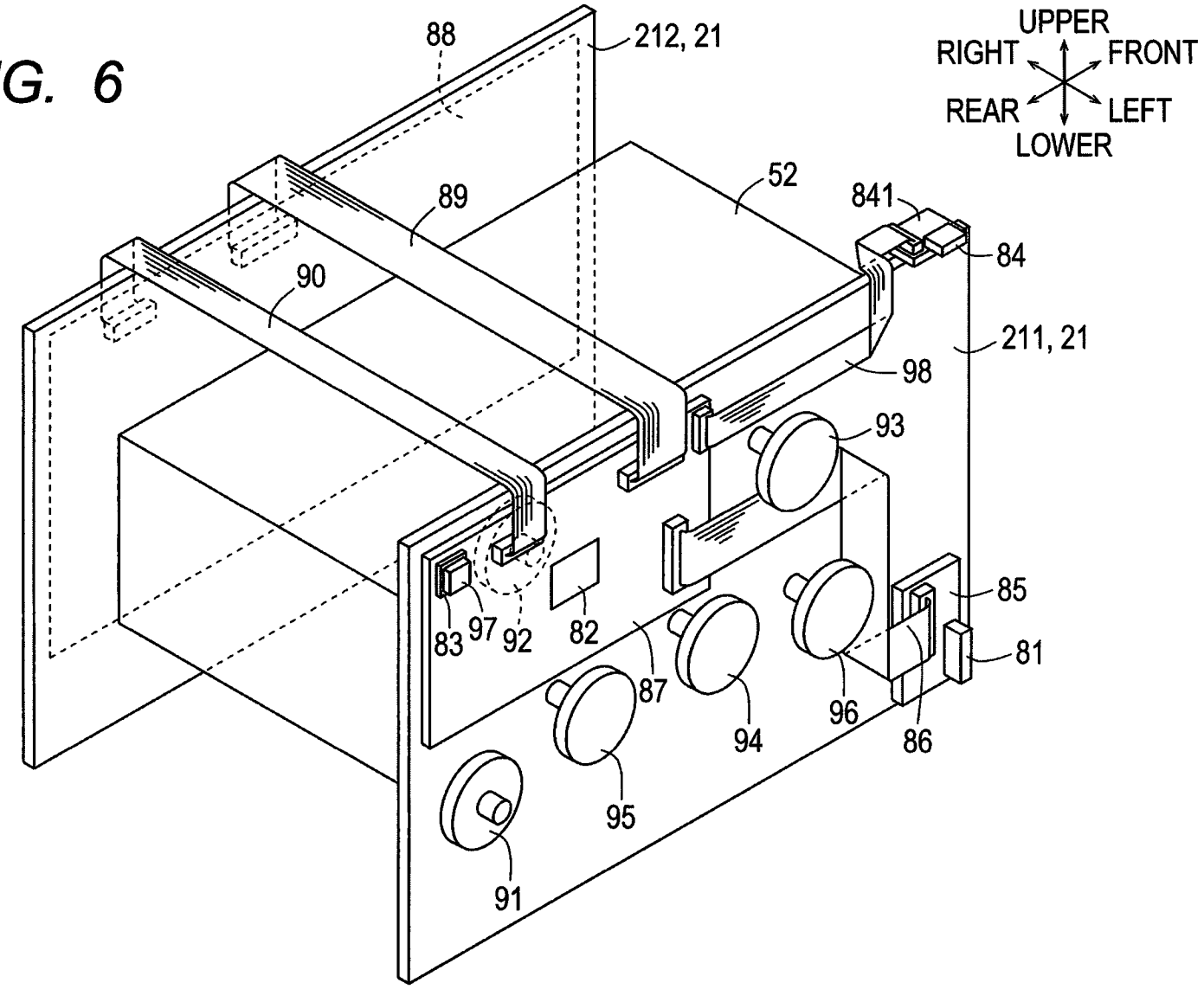
FIG. 6 is a perspective view of a relevant configuration in the image forming apparatus of the embodiment.

As shown in FIG. 6, the frame 21 includes a first frame 211 and a second frame 212. The first frame 211 and the second frame 212 are arranged to face each other in the right-left direction. The first frame 211 and the second frame 212 extend in the front-rear direction and in the vertical direction. The first frame 211 is located at a left end portion of the interior of the housing 2. The second frame 212 is located at a right end portion of the interior of the housing 2. Thus, the first frame 211 is closer to the left wall 22C than the second frame 212 is in the left-right direction.

The first drive motor 91, the second drive motor 92, the third drive motor 93, the fourth drive motor 94, the fifth drive motor 95, and the sixth drive motor 96 are attached to the first frame 211. The first drive motor 91 is a motor for driving the switchback roller pair 71 and the intermediate re-conveyance roller pair 72. The second drive motor 92 is a motor for driving the discharge roller pair 75 and the intermediate discharge roller pair 74.

The third drive motor 93 is a motor for driving the development roller 513. The fourth drive motor 94 is a motor for driving the photosensitive drum 511. The fifth drive motor 95 is a motor for driving the fixing unit 6. The sixth drive motor 96 is a motor for driving the feed roller 32, the separation roller 33, the conveyance roller pair 35, the registration roller pair 36, and the re-conveyance roller pair 73.

The first drive motor 91 and the second drive motor 92 are arranged at a rear portion of the housing 2. The first drive motor 91 is arranged at a lower position than the branch position Ps. The second drive motor 92 is arranged at a higher position than the branch position Ps.

The third drive motor 93 is arranged at a higher position than the photosensitive drum 511, that is, at an upper portion of the housing 2. The fourth drive motor 94, the fifth drive motor 95, and the sixth drive motor 96 are arranged at a lower position than the photosensitive drum 511, that is, at a lower portion of the housing 2.

The sixth drive motor 96 is located farther forward than the fourth drive motor 94 and the fifth drive motor 95. The fourth drive motor 94 is located farther forward than the fifth drive motor 95. The sixth drive motor 96 is located at a lower position than the fourth drive motor 94 and the fifth drive motor 95.

The following describes a characteristic configuration of the image forming apparatus 1. The image forming apparatus 1 includes an operation panel unit 4, a temperature-humidity sensor 81, a controller 82, a connector 83, and a USB port 84.

[Operation Panel Unit]

Figure 3:
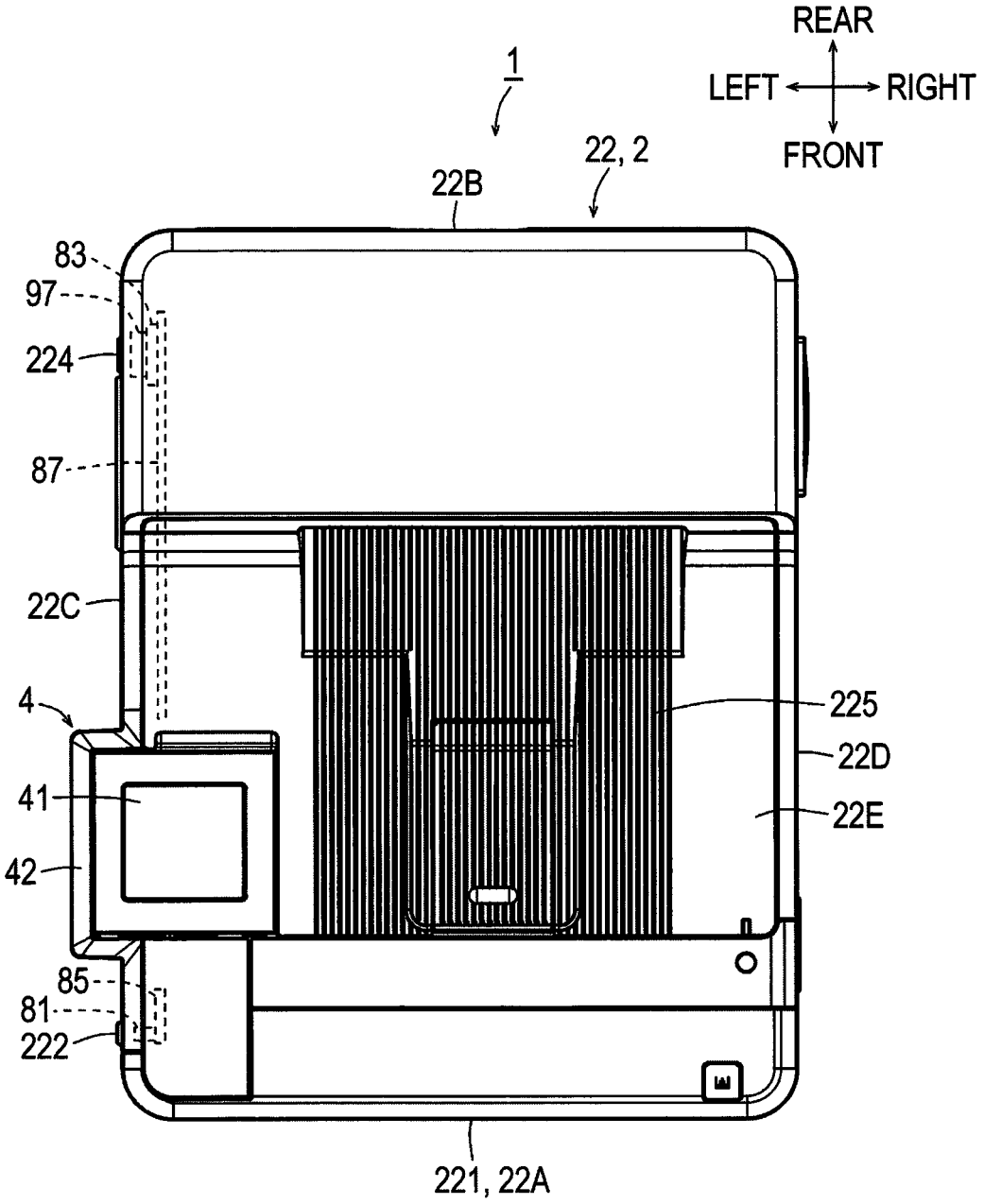
FIG. 3 is a plan view of the image forming apparatus of the embodiment.
Figure 4:
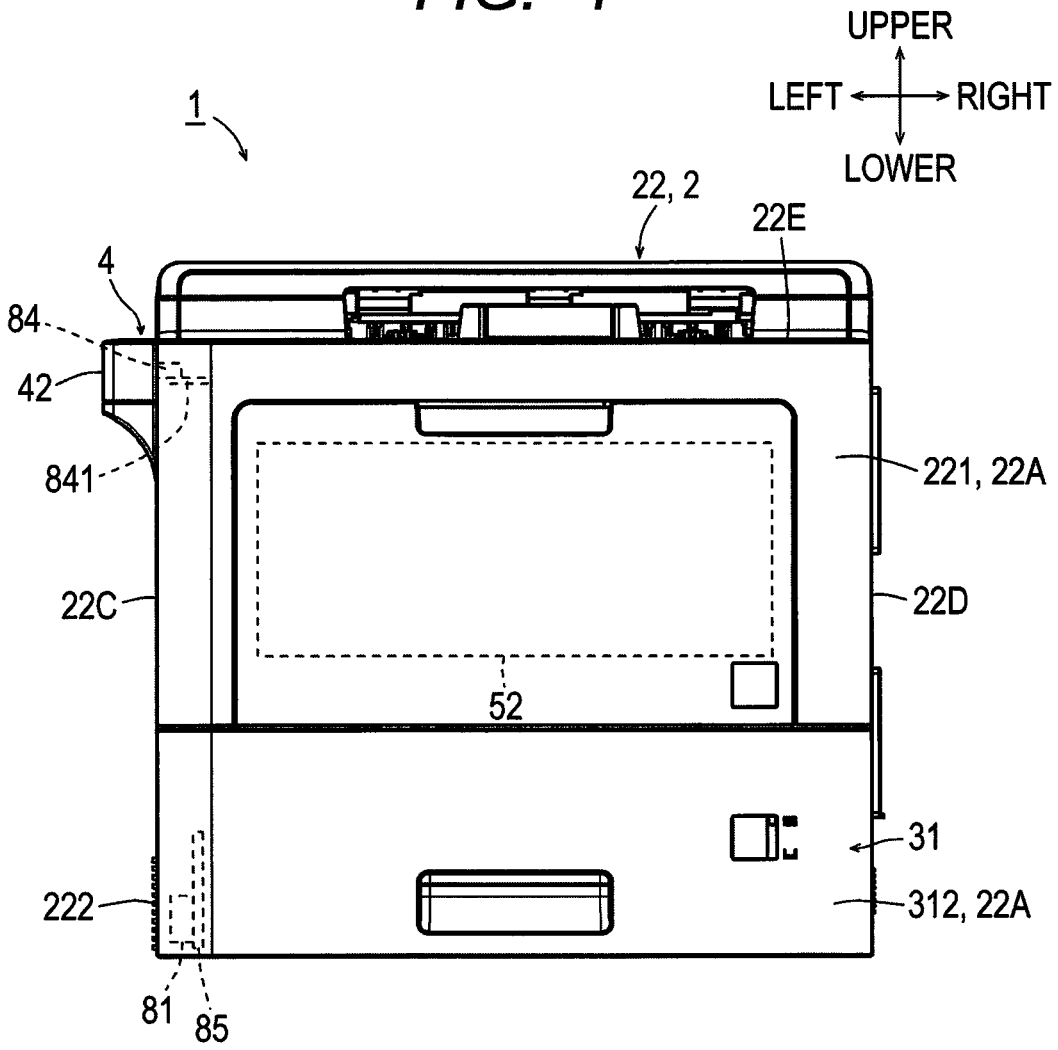
FIG. 4 is a front view of the image forming apparatus of the embodiment.

As shown in FIGS. 2 to 4, the operation panel unit 4 includes an operation panel 41 and a panel accommodating portion 42. The operation panel 41 is a touch panel arranged at the upper wall 22E of the cover 22 and used for making an input operation to the image forming apparatus 1 and displaying the status of the image forming apparatus 1. The operation panel 41 is required at least to allow an input operation and may be an operation interface such as an operation button.

The panel accommodating portion 42 is a housing in which the operation panel 41 is accommodated, and has an exterior including a part of the cover 22. The panel accommodating portion 42 may be a separate member from the cover 22. The panel accommodating portion 42 is arranged to partially protrude leftward farther than the outer surface of the left wall 22C of the cover 22. The protruding part may be at least part of the operation panel unit 4, and a part of the operation panel 41 and a part of the panel accommodating portion 42 may protrude, for example. Further, the protruding part only need to protrude farther outward than the outer surface of the second side wall of the housing 2. Thus, in a case where the front wall 22A is the first side wall as in this embodiment, the protruding part may protrude farther outward than the outer surface of the left wall 22C or the outer surface of the right wall 22D.

Figure 5:
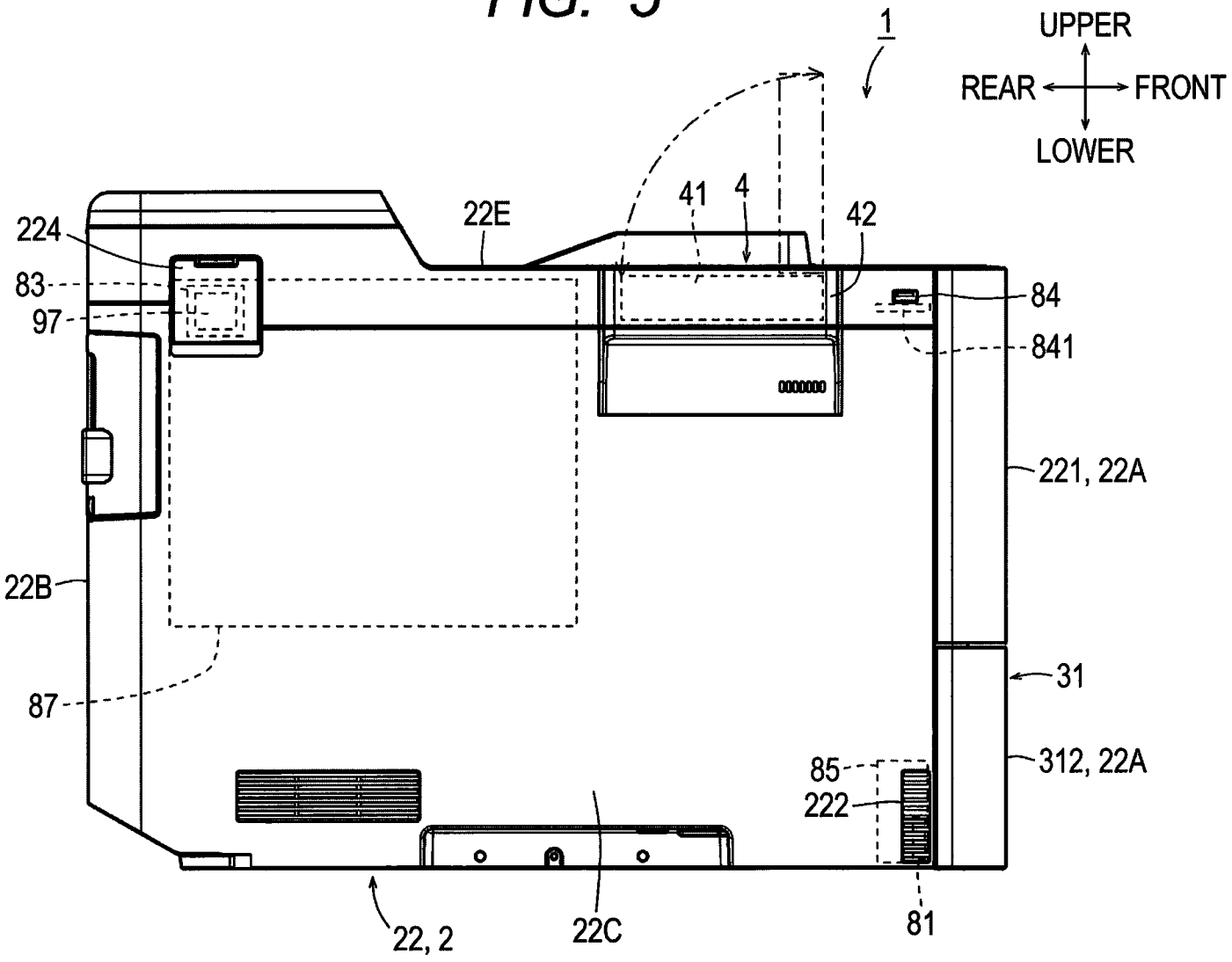
FIG. 5 is a left side view of the image forming apparatus of the embodiment.

As shown in FIG. 5, the operation panel 41 is configured to rotationally move about its front end relative to the panel accommodating portion 42. The operation panel 41 is movable between a position at which a display surface of the operation panel 41 is parallel to the upper wall 22E of the cover 22 and a position at which the display surface is perpendicular to the upper wall 22E. This allows the operation panel 41 to be adjusted at an angle facilitating operation and visual recognition of the operation panel 41. The operation panel 41 may be fixed so as to disable rotational movement relative to the panel accommodating portion 42.

[Temperature-Humidity Sensor]

As shown in FIGS. 3 to 6, the temperature-humidity sensor 81 faces the vent 222 provided at the left wall 22C of the cover 22, and is arranged between the drawer 52 and the left wall 22C in the right-left direction. The temperature-humidity sensor 81 is arranged between the first frame 211 and the left wall 22C in the left-right direction. The temperature-humidity sensor 81 is an integrated unit of a temperature sensor and a humidity sensor. The temperature-humidity sensor 81 detects the ambient temperature and the ambient humidity in a place where the image forming apparatus 1 is installed by detecting the temperature and humidity of outer air taken in through the vent 222.

If the image forming apparatus 1 is installed such that the left wall 22C is in proximity to a wall surface of a place of the installation, the operation panel unit 4 protruding leftward contacts the wall surface, thereby preventing the vent 222 from becoming closer to the wall surface than a certain distance (certain gap). This achieves sufficient intake of outer air through the vent 222, thereby allowing the temperature-humidity sensor 81 to detect the ambient temperature and the ambient humidity with high accuracy in the place where the image forming apparatus 1 is installed.

The temperature-humidity sensor 81 does not necessarily need to be arranged to face the vent 222 but may be arranged at a position at which the temperature and humidity of outer air taken in through the vent 222 are detectable. For example, the temperature-humidity sensor 81 may be arranged at a position around the vent 222 and not facing the vent 222.

Preferably, the temperature-humidity sensor 81 is arranged at a lower position than the drive motor closest to the temperature-humidity sensor 81. As shown in FIG. 1, in this embodiment, the temperature-humidity sensor 81 is arranged at a lower position than the sixth drive motor 96 nearest to the temperature-humidity sensor 81. This reduces influence on a result of detection by the temperature-humidity sensor 81 to be caused by heat generated from the sixth drive motor 96 as the heat generated from the sixth drive motor 96 goes up inside the housing 2. In this embodiment, as the temperature-humidity sensor 81 is arranged at a lower position than all of the drive motors 91 to 96, the influence on the temperature-humidity sensor 81 to be caused by heat generated from the drive motors 91 to 96 is minimized.

Preferably, the temperature-humidity sensor 81 is located within the range of the height of the sheet tray 31, and more preferably, within the range of the height of the sheets S. As shown in FIG. 1, in this embodiment, the lower end of the temperature-humidity sensor 81 is located at the substantially same height as the lower end of the tray cover 312 of the sheet tray 31. As printing quality is influenced by the temperature or moisture content of the sheet S, detecting the ambient temperature or the ambient humidity in a position near the sheet S before image formation achieves printing control with high accuracy.

As shown in FIGS. 3 and 4, the temperature-humidity sensor 81 is mounted on a first board 85. The first board 85 is provided on the left surface of the first frame 211. Namely, the first board 85 is arranged between the drawer 52 and the left wall 22C (the second side wall) and is arranged parallel to the left wall 22C. Because the temperature-humidity sensor 81 and the first board 85 are located between the drawer 52 and the left wall 22C, a space-saving layout can be achieved. Because the first board 85 is arranged parallel to the left wall 22C, a further space-saving layout can be achieved.

The first board 85 functions as a sub control board. In addition to being a board for mounting of the temperature-humidity sensor 81, the first board 85 is electrically connected to clutches (not shown) of the feed roller 32, the separation roller 33, the conveyance roller pair 35, the registration roller pair 36, and so on. As shown in FIG. 6, the first board 85 is connected to a second board 87 described later via a flexible flat cable (FFC) 86. Thus, the temperature-humidity sensor 81, the feed roller 32, the separation roller 33, the conveyance roller pair 35, and the registration roller pair 36 can be controlled by the controller 82.

As shown in FIG. 1, the temperature-humidity sensor 81 is arranged at the opposite side of the fixing unit 6 with respect to the center of the housing 2 in the front-rear direction. That is, the temperature-humidity sensor 81 is arranged farther forward than the center of the housing 2. This reduces the influence on a result of detection by the temperature-humidity sensor 81 to be caused by heat from the fixing unit 6.

The temperature-humidity sensor 81 is used in this embodiment. Alternatively, a temperature sensor and a humidity sensor may be provided separately, or one of a temperature sensor and a humidity sensor may be used. The first board 85 may not be provided. The temperature-humidity sensor 81 may be provided at the first frame 211 without using the first board 85.

[Controller]

As shown in FIG. 6, the controller 82 is mounted on the second board 87 provided on the left surface of the first frame 211, and is configured by a central processing unit (CPU). The controller 82 controls the feed unit 3, the image forming unit 5, the fixing unit 6, the sheet conveyance unit 7, the drive motors 91 to 96, the operation panel unit 4, the temperature-humidity sensor 81, a device connected to the connector 83, and a device connected to the USB port 84.

The second board 87 is a main control board and is arranged at a different position from the first board 85, which is an upper rear position of the first frame 211 in this embodiment. More specifically, as shown in FIG. 6, the temperature-humidity sensor 81 is arranged at the opposite side of the controller 82 with respect to the center of the housing 2 in the front-rear direction. With this arrangement, the controller 82 is located at a position separated from the temperature-humidity sensor 81, which reduces influence on a result of detection by the temperature-humidity sensor 81 to be caused by heat generated from the controller 82.

A high-voltage circuit board 88 is provided on the right surface of the second frame 212. The high-voltage circuit board 88 is connected to the second board 87 via an FFC 89 and an FFC 90. With this arrangement, the high-voltage circuit board 88 is controlled by the controller 82 to apply voltages to the charger 512 and the development roller 513. In this way, the high-voltage circuit board 88 is arranged at a position separated from the temperature-humidity sensor 81. More specifically, the temperature-humidity sensor 81 is provided at the outer surface of the first frame 211 facing opposite the second frame 212, and the high-voltage circuit board 88 is provided at the outer surface of the second frame 212 facing opposite the first frame 211. This arrangement reduces influence on a result of detection by the temperature-humidity sensor 81 to be caused by heat generated from the high-voltage circuit board 88.

[Connector]

As shown in FIGS. 2, 3, and 5, the connector 83 is provided at a position facing the second opening 223 at the left wall 22C of the cover 22. As shown in FIG. 6, the connector 83 is mounted on the second board 87. The connector 83 is a terminal to which an optional part is to be connected. In this embodiment, a WLAN board 97 is connected to the connector 83. The image forming apparatus 1 receives data through the WLAN board 97 from a PC or a smartphone, for example.

As described above, the connector 83 is located at a position facing the second opening 223. Thus, even if the image forming apparatus 1 is installed such that the left wall 22C is in proximity to a wall surface of a place of the installation, the operation panel unit 4 protruding leftward contacts the wall surface, thereby preventing the second opening 223 from becoming closer to the wall surface than a certain distance. An optional part such as the WLAN board 97 can be connected to the connector 83 through the second opening 223 without moving the image forming apparatus 1.

[USB Port]

As shown in FIGS. 2, 4, and 5, the USB port 84 is provided on the left wall 22C of the cover 22 and at a farther forward position than the operation panel unit 4, which is an upper front position of the left wall 22C in this embodiment. The USB port 84 is a port configured for insertion of a USB memory, and allows the image forming apparatus 1 to directly read data stored in the inserted USB memory. The USB port 84 is mounted on a USB board 841. As shown in FIG. 6, the USB board 841 is connected to the second board 87 via an FFC 98. Thus, the USB port 84 can be controlled by the controller 82.

As described above, the USB port 84 is located on the left wall 22C of the cover 22. Thus, even if the image forming apparatus 1 is installed such that the left wall 22C is in proximity to a wall surface of a place of the installation, the operation panel unit 4 protruding leftward contacts the wall surface, thereby preventing the USB port 84 from becoming closer to the wall surface than a certain distance. Thus, a USB memory can be easily inserted to the USB port 84. Also, the USB port 84 is located on the left wall 22C of the cover 22 at a farther forward position than the operation panel unit 4. This allows a user to access the USB port 84 easily from the front side of the image forming apparatus 1, which reduces the likelihood that the user contacts the inserted USB memory by mistake.

While the disclosure has been described in detail with reference to the above aspects thereof, it would be apparent to those skilled in the art that various changes and modifications may be made therein without departing from the scope of the claims.

What is claimed is:

1. An image forming apparatus comprising:

a housing including:

a first side wall having a first opening; and a second side wall having a vent and extending in a direction crossing the first side wall;

a drawer supporting a cartridge, the drawer being movable through the first opening between an inner position at which the drawer is accommodated in the housing and an outer position at which a part of the drawer is exposed to outside the housing;

an operation panel, at least part of the operation panel protruding from an outer surface of the second side wall; and a sensor arranged in the housing between the drawer and the second side wall, the sensor being configured to detect at least temperature or humidity of ambient air taken in through the vent.

2. The image forming apparatus according to claim 1, further comprising a plurality of drive motors, wherein the sensor is located at a lower position than a drive motor closest to the sensor.

3. The image forming apparatus according to claim 1, further comprising a sheet tray configured to support a sheet, the sheet tray being movable between an accommodated position at which the sheet tray is accommodated in the housing and a pulled-out position at which the sheet tray is pulled out from the housing, wherein the sensor is located within a range of the sheet tray in a vertical direction.

4. The image forming apparatus according to claim 1, wherein the second side wall has a second opening; and wherein the image forming apparatus further comprises a connector facing the second opening.

5. The image forming apparatus according to claim 1, further comprising a USB port arranged at the second side wall, the USB port being closer to the first side wall than the operation panel is.

6. The image forming apparatus according to claim 1, further comprising a first board on which the sensor is mounted, the first board being arranged between the drawer and the second side wall, the first board extending parallel to the second side wall.

7. The image forming apparatus according to claim 6, further comprising:

an image forming unit configured to form an image on a sheet;

a controller configured to control the image forming unit; and a second board on which the controller is mounted, the second board being arranged at a different position from the first board.

8. The image forming apparatus according to claim 1, further comprising a fixing unit configured to fix an image on a sheet, wherein the sensor is arranged at an opposite side of the fixing unit with respect to a center of the housing in a direction in which the second side wall extends.

9. The image forming apparatus according to claim 2, wherein the sensor is located at a lower position than all of the plurality of drive motors.

10. The image forming apparatus according to claim 7, wherein the sensor is arranged at an opposite side of the controller with respect to a center of the housing in a direction in which the second side wall extends.

11. The image forming apparatus according to claim 1, further comprising a high-voltage circuit board, wherein the housing includes a first frame and a second frame arranged to face each other in a first direction in which the first side wall extends, the first frame being located at one end of the housing in the first direction, the second frame being located at an other end the housing in the first direction;

wherein the sensor is provided at a surface of the first frame facing opposite the second frame; and wherein the high-voltage circuit board is provided at a surface of the second frame facing opposite the first frame.

12. An image forming apparatus comprising:

a housing including:

a first side wall having a first opening;

a second side wall having a vent and crossing the first side wall; and a first frame and a second frame arranged to face each other in a first direction, wherein the first frame is closer to the second side wall than the second frame is in the first direction;

an operation panel, at least part of the operation panel protruding from an outer surface of the second side wall in the first direction; and a sensor arranged in the housing between the first frame and the second side wall in the first direction, the sensor being configured to detect at least temperature or humidity of ambient air taken in through the vent.

* * * * *